United States Patent [19]

Kimura et al.

[11] Patent Number: 4,487,497

[45] Date of Patent: Dec. 11, 1984

[54] OPTICAL DEVICE IN VARIABLE MAGNIFICATION ELECTROSTATIC COPYING APPARATUS

[75] Inventors: Hiroshi Kimura, Habikino; Masahiko Hisajima, Osaka; Kiyoshi Morimoto, Osaka; Kiyoshi Shibata, Osaka; Takashi Nagashima, Sakai; Yasuhiko Yoshikawa; Masahiro Watashi, both of Ikoma; Kiyonori Yamamoto, Neyagawa; Toshihiko Yamamoto, Takaishi; Shinsuke Yoshinaga, Sakai, all of Japan

[73] Assignee: Mita Industrial Co., Ltd., Osaka, Japan

[21] Appl. No.: 432,101

[22] Filed: Sep. 29, 1982

[30] Foreign Application Priority Data

Nov. 30, 1981 [JP] Japan ..... 56-192394

[51] Int. Cl.[3] ..... G03G 15/28

[52] U.S. Cl. ..... 355/8; 355/60

[58] Field of Search ..... 355/8, 11, 55, 56, 57, 355/58, 66, 60

[56] References Cited

U.S. PATENT DOCUMENTS

| | | | |
|---|---|---|---|
| 3,884,574 | 5/1975 | Doi et al. | 355/8 X |
| 4,125,323 | 11/1978 | Ikeda et al. | 355/8 |
| 4,126,389 | 11/1978 | Ikeda et al. | 355/60 X |
| 4,142,793 | 3/1979 | Schilling | 355/8 X |
| 4,168,905 | 9/1979 | Kitajima | 355/8 X |
| 4,295,736 | 10/1981 | Ikeda | 355/57 |
| 4,335,953 | 6/1982 | Tsuchiya | 355/57 X |

FOREIGN PATENT DOCUMENTS 2073899 11/1981 United Kingdom .

*Primary Examiner*—John Gonzales
*Assistant Examiner*—J. Pendegrsss
*Attorney, Agent, or Firm*—Wenderoth, Lind & Ponack

[57] ABSTRACT

An optical device in a variable magnification electrostatic copying apparatus includes a first reflecting mirror assembly mounted for reciprocal movement, a second reflecting mirror assembly mounted for reciprocal movement substantially parallel to the reciprocating direction of the first reflecting mirror assembly, and a speed-reduction interlocking mechanism for moving the second reflecting mirror assembly at a speed equal to one-half of the moving speed of the first reflecting mirror assembly, upon movement of the first reflecting mirror assembly. The optical device further includes a magnification setting mechanism for changing the relative position of the second reflecting mirror assembly with respect to the first reflecting mirror assembly according to a desired copying magnification. The magnification setting mechanism comprises a setting cam having a plurality of acting portions corresponding to a plurality of magnification values and a setting member adapted to be held by the setting cam at any one of a plurality of setting positions corresponding to the plurality of magnification values. The changing of the position of the setting member causes a change in the relative position of the second reflecting mirror assembly with respect to the first reflecting mirror assembly.

4 Claims, 3 Drawing Figures

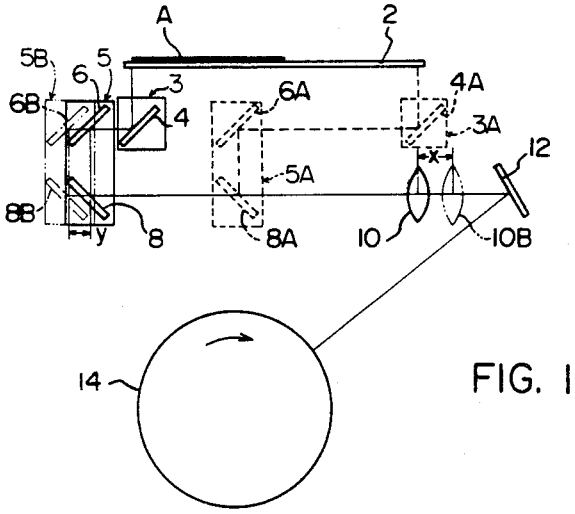
FIG. 1
FIG. 3
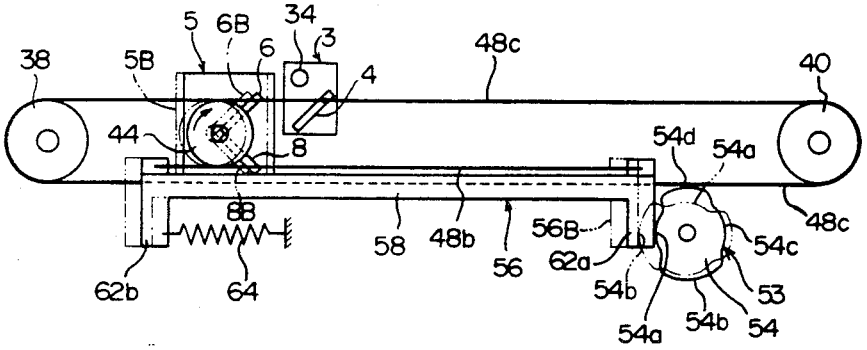

OPTICAL DEVICE IN VARIABLE MAGNIFICATION ELECTROSTATIC COPYING APPARATUS

FIELD OF THE INVENTION

This invention relates to an optical device in an electrostatic copying apparatus capable of performing variable magnification copying. More specifically, it relates to an optical device in a variable magnification electrostatic copying apparatus, which comprises a first reflecting mirror assembly adapted for movement at a predetermined speed selected according to a magnification value and a second reflecting mirror assembly adapted for movement at a speed equal to one half of the moving speed of the first reflecting mirror assembly and in which, when the copying magnification value is changed, the relative position of the second reflecting mirror assembly with respect to the first reflecting mirror assembly is changed.

DESCRIPTION OF THE PRIOR ART

A so-called stationary document-type electrostatic copying apparatus in which an original document to be copied is placed on a stationary transparent plate includes an optical device for projecting an image of the document placed on the stationary transparent plate onto a photosensitive member disposed, for example, on a rotating drum. As is well known, the most widely used type of optical device comprises a stationary lens, a first reflecting mirror assembly mounted for reciprocal movement along the stationary transparent plate, a second reflecting mirror assembly mounted for reciprocal movement substantially parallel to the reciprocating direction of the first reflecting mirror assembly, and a speed-reduction interlocking mechanism for moving the second reflecting mirror assembly at a speed equal to one-half of the moving speed of the first reflecting mirror assembly upon the movement of the first reflecting mirror assembly.

On the other hand, frequently it has been desired in recent years to provide a variable magnification electrostatic copying apparatus capable of giving copies not only on an equal scale but also on an enlarged or reduced scale with respect to the original document. In order to perform variable magnification copying in an electrostatic copying apparatus equipped with the aforesaid optical device, it is necessary, in the optical device, to change the relative position of the second reflecting mirror assembly to the first reflecting mirror assembly as well as to change the position of the stationary lens to a position corresponding to a selected magnification value and to change the moving speeds of the first and second reflecting mirror assemblies to values corresponding to the selected magnification. Optical devices which meet these requirements are disclosed, for example, in Japanese Laid-Open Patent Publication No. 76545/1973 and Japanese Utility Model Publications Nos. 41860/1977 and 39543/1978. These known optical devices, however, present some problems as described below owing to the provision of means for changing the relative position of the second reflecting mirror assembly to the first reflecting mirror assembly according to the selected magnification value.

(a) The aforesaid speed-reduction interlocking mechanism comprising a plurality of pulleys and a wire rope is considerably complex and expensive.

(b) An optical device which does not meet the aforesaid requirements must be modified drastically in order to make it meet these requirements.

(c) When the relative position of the second reflecting mirror assembly to the first reflecting mirror assembly is changed, the length and/or tension of the wire rope in the aforesaid speed-reduction interlocking mechanism varies, and consequently, the reciprocating movement of the second reflecting mirror assembly becomes unstable.

SUMMARY OF THE INVENTION

It is an object of this invention to provide a relatively simple and inexpensive optical device which meets the aforesaid requirements for variable magnification copying.

Another object of this invention is to provide an optical device meeting the aforesaid requirements for variable magnification copying, which is obtained by attaching a relatively simple mechanism to an existing conventional optical device which does not meet the aforesaid requirements for variable magnification copying.

Still another object of this invention is to provide an optical device which meets the aforesaid requirements for variable magnification copying, and in which the reciprocating movements of the first and second reflecting mirror assemblies are carried out fully stably even when the relative position of the second reflecting mirror assembly to the first reflecting mirror assembly is changed.

According to this invention, there is provided, for use in a variable magnification electrostatic copying apparatus, an optical device comprising a first reflecting mirror assembly mounted for reciprocal movement along a stationary transparent plate on which is placed a document to be copied, the first reflecting mirror assembly being drivingly connected to a driving power source so that it is moved at a predetermined speed selected according to a copying magnification, a second reflecting mirror assembly mounted for reciprocal movement substantially parallel to the reciprocating direction of the first reflecting mirror assembly, and a speed-reduction interlocking mechanism for moving the second reflecting mirror assembly at a speed equal to one-half of the moving speed of the first reflecting mirror assembly according to the movement of the first reflecting mirror assembly. Such mechanism includes a pair of stationary pulleys mounted rotatably in spaced-apart relationship in the reciprocating direction of the first and second reflecting mirror assemblies, a movable pulley mounted rotatably on the second reflecting mirror assembly, and a rope wrapped about the pair of stationary pulleys and the movable pulley and fixed to the first reflecting mirror assembly. A magnification setting mechanism changes the relative position of the second reflecting mirror assembly with respect to the first reflecting mirror assembly according to the magnification value. The magnification setting mechanism includes a setting cam having a plurality of acting portions corresponding to a plurality of magnification values and a setting member mounted for movement substantially parallel to the reciprocating direction of the first and second reflecting mirror assemblies and adapted to the held by the setting cam at any one of a plurality of setting positions corresponding to the plurality of magnification values. Opposite free end portions of the rope of the reduction interlocking mechanism are wrapped over the movable pulley in mutually opposite directions and then fixed to the setting member. When the setting member is moved, the movable pulley is correspondingly moved to move the second reflecting mirror assembly.

BRIEF DESCRIPTION OF THE DRAWINGS

FIG. 1 is a simplified view showing one example of an optical device to which the present invention is applied;

FIG. 3 is a simplified view for illustrating the operation of the optical device shown in FIG. 2.

DETAILED DESCRIPTION OF THE PREFERRED EMBODIMENTS

Figure 2:
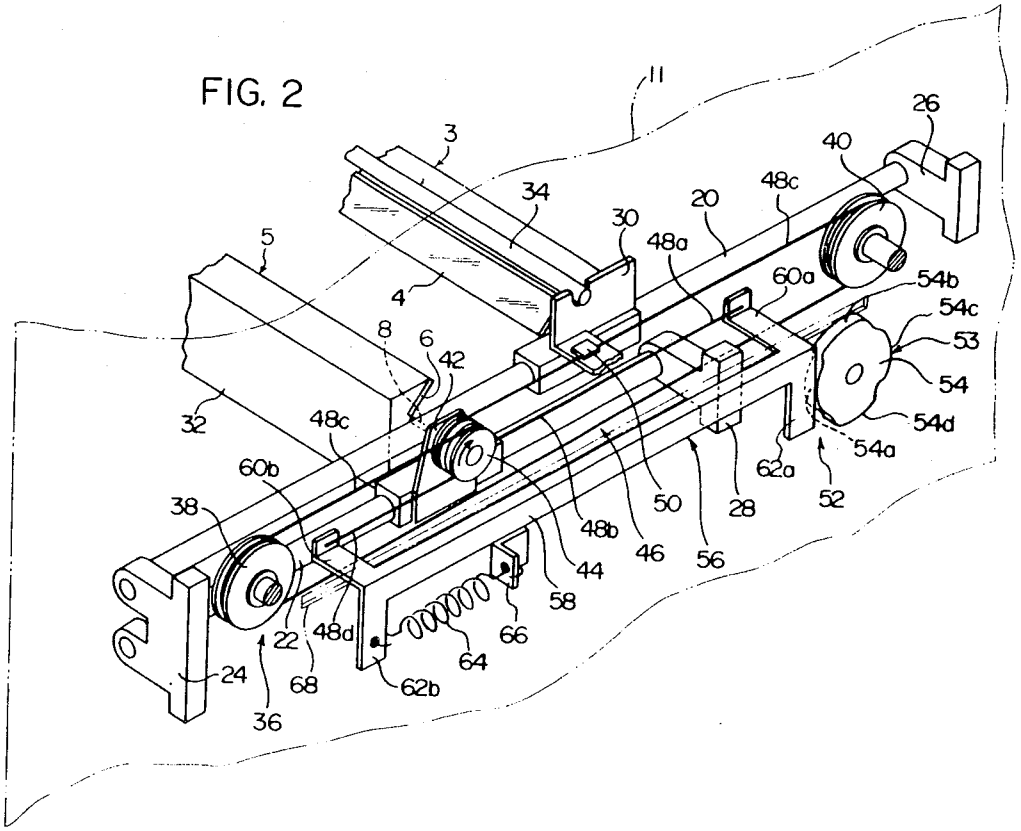
FIG. 2 is a perspective view showing a part of one specific example of the optical device constructed in accordance with this invention.

The basic construction of one embodiment of the optical device to which the present invention is applied will be described with reference to FIG. 1. The optical device for projecting the image of a document A placed on a substantially horizontally disposed stationary transparent plate 2 onto a photosensitive member disposed on a rotating drum 14 rotating at a predetermined speed in the direction of the arrow is comprised of a first reflecting mirror assembly 3 having a first movable reflecting mirror 4, a second reflecting mirror assembly 5 having a second movable reflecting mirror 6 and a third movable reflecting mirror 8, a stationary lens 10 and a stationary reflecting mirror 12. The first reflecting mirror assembly 3 is mounted so that it is free to reciprocate substantially horizontally along the stationary transparent plate 2. The first movable reflecting mirror 4 in the first reflecting mirror assembly 3 is inclined at an angle of about 45 degrees to the stationary transparent plate 2. The second reflecting mirror assembly 5 is also mounted for reciprocal movement in a substantially horizontal direction and therefore in a direction substantially parallel to the reciprocating direction of the first reflecting mirror assembly 3. The second movable reflecting mirror 6 in the second reflecting mirror assembly 5 is inclined at an angle of about 45 degrees to the stationary transparent plate 2 in a direction substantially parallel to the direction of inclination of the first movable reflecting mirror 4. The third movable reflecting mirror 8 is set substantially at a right angle to the second movable reflecting mirror 6.

When a copy on an equal scale to the document (magnification 1:1) is to be obtained, the first reflecting mirror assembly 3 is moved from the position shown by solid lines to the position 3A shown by broken lines at substantially the same speed as the peripheral speed of the rotating drum 14. At the same time, the second reflecting mirror assembly 5 is moved from the position shown by solid lines to the position 5A shown by broken lines at a speed equal to one-half of the moving speed of the first reflecting mirror assembly 3. Thus, the image of the document A placed on the stationary transparent plate 2 is projected substantially at a magnification of 1:1 onto the photosensitive member on the rotating drum 14 through the first movable reflecting mirror 4, the second movable reflecting mirror 6, the third movable reflecting mirror 8, the stationary lens 10 and the stationary reflecting mirror 12.

When a copy is to be obtained at a magnification ratio of m, the position of the stationary lens 10 is changed from the position shown by solid lines to the position 10B shown by two-dot chain lines prior to the performance of a copying operation. Furthermore, the second reflecting mirror assembly 5 is moved from the position shown by solid lines to the position 5B shown by two-dot chain lines, and as a result, the position of the second reflecting mirror assembly 5 relative to the first reflecting mirror assembly 3 is changed. Then, the copying operation is started, and the first reflecting mirror assembly 3 is moved to the right from the position shown by the solid lines at a speed one-mth of the peripheral speed of the rotating drum 14. At the same time, the second reflecting mirror assembly 5 is moved to the right from the position 5B shown by the two-dot chain lines at a speed equal to one-half of the moving speed of the first reflecting mirror assembly 3. Consequently, the image of the document A placed on the transparent plate 2 is projected onto the photosensitive member on the rotating drum 14 at a magnification ratio of m through the first movable reflecting mirror 4, the second movable reflecting mirror 6, the third movable reflecting mirror 8, the stationary lens 10 and the stationary reflecting mirror 12.

Now, the moving distance of the position of the stationary lens 10 and the moving distance of the position of the second reflecting mirror assembly 5 will be considered when it is assumed that a copy at a magnification ratio of m is to be obtained. From an optical theory with regard to lens, the following equations must hold good.

$$m = \frac{b - x}{a + x + 2y} \tag{1}$$

$$\frac{1}{a + x + 2y} + \frac{1}{b - x} = \frac{1}{f} \tag{2}$$

where f: the focal distance of the lens 10, a: the optical distance between the document A and the lens 10, b: the optical distance between the lens 10 and the photosensitive member, x: the moving distance of the lens 10 (if it is positive, it is in the right direction in FIG. 1), and y: the moving distance of the second reflecting mirror assembly 5 (if it is positive, it is in the left direction in FIG. 1).

In the case of a magnification of 1:1, a=b. Hence, let a=b, x and y can be determined as follows from equations (1) and (2).

$$x = f(1 - m)$$

$$y = \frac{f(1 - m)^2}{2m}$$

Now, one specific embodiment of the optical device constructed in accordance with this invention will be described with reference to FIGS. 2 and 3.

Within a housing (not shown) of an electrostatic copying apparatus, a pair of upstanding side plates 11 (only one of which is partly shown in FIG. 2 by a two-dot chain line) are disposed in spaced-apart relationship in a lateral direction (the direction perpendicular to the sheet surface in FIG. 1) with respect to the reciprocating direction of the first and second reflecting mirror assemblies 3 and 5. Securing brackets 24, 26 and 28 are fixed to the inside surface of each of the upstanding side plates 11. A mounting rod 20 extending substantially horizontally along the stationary transparent plate 2 (FIG. 1) is fixed to the brackets 24 and 26, and a mounting rod 22 extending substantially parallel to the mounting rod 20 is fixed to the brackets 24 and 28 (in FIG. 2, only the mounting rods 20 and 22 fixed to one of the upstanding side plates 11 are shown).

A supporting frame 30 for the first reflecting mirror assembly 3 is mounted on a pair of the mounting rods 20 such that it is free to slide along the rods 20. Likewise, a supporting frame 32 for the second reflecting mirror assembly 5 is mounted on a pair of the mounting rods 22 such that it is free to slide along the rods 22. To the support frame 30 for the first reflecting mirror assembly 3 are fixed a light source 34 for illuminating the document A (FIG. 1) placed on the stationary transparent plate 2 and the first movable reflecting mirror 4 (see FIG. 1). The second movable reflecting mirror 6 and the third movable reflecting mirror 8 are fixed to the supporting frame 32 for the second reflecting mirror assembly 5 (see FIG. 1).

The optical device further includes a speed-reduction interlocking mechanism shown generally at 36 for moving the second reflecting mirror assembly 5 at a speed equal to one-half of the moving speed of the first reflecting mirror assembly 3, upon movement of the first reflecting mirror assembly 3. The reduction interlocking mechanism 36 comprises a pair of stationary pulleys 38 and 40 mounted rotatably on the inside of one of the upstanding side plates 11 in spaced-apart relationship in the moving direction of the first and second reflecting mirror assemblies 3 and 5, a movable pulley 44 rotatably secured to a bracket 42 fixed to the supporting frame 32 for the second reflecting mirror assembly 5, and a wire rope or cable 46 wrapped about the stationary pulleys 38 and 40 and the movable pulley 44. The wire rope 46 has a section **48*b* which extends from its one end 48*a* fixed to a setting member 56 (which will be described in detail hereinafter), is wrapped about the movable pulley 44, then terminates in a fixed portion 50 of the supporting frame 30 for the first reflecting mirror assembly 3, and is fixed there, and a section 48*c* which extends from the fixed portion 50 of the supporting frame 30 for the first reflecting mirror assembly 3, is wrapped about the stationary pulley 40, the stationary pulley 38 and then the movable pulley 44 and then terminates in the other end 48*d* fixed to the setting member 56**.

It will be appreciated therefore that when the first reflecting mirror assembly 3 is caused to reciprocate to the right and left in FIGS. 1 and 3 by a driving power source (not shown) such as an electric motor to which the first reflecting mirror assembly 3 is connected through a suitable drivingly connecting means (not shown), the second reflecting mirror assembly 5 is moved in the same direction as the moving direction of the first reflecting mirror assembly 3 at a speed equal to one-half of the moving speed of the first reflecting mirror assembly 3 by the action of the reduction interlocking mechanism 36.

The optical device constructed in accordance with this invention includes a magnification setting mechanism shown generally at 52 for changing the relative position of the second reflecting mirror assembly 5 to the first reflecting mirror assembly 3 according to a magnification of copying. The magnification setting mechanism 52 includes a setting cam 53 and the setting member 56. The setting cam 53 is composed of a cam plate 54 mounted rotatably on the outside of one of the upstanding side plates 11 and adapted for rotation in relation to the movement of the stationary lens 10 for positional change. The cam plate 54 has on its peripheral surface a plurality of acting portions **54*a*, 54*b*, 54*c* and 54*d* corresponding to a plurality of copying magnification ratios. The setting member 56 is mounted for sliding movement in the reciprocating direction of the first and second reflecting mirror assemblies 3 and 5. The setting member 56 has a main portion 58 which is located outwardly of one of the upstanding side plates 11 and extends in the reciprocating direction of the first and second reflecting mirror assemblies 3 and 5, and connecting portions 60*a* and 60*b* which respectively project laterally from the opposite ends of the main portion 58 to the inside of one of the upstanding side plates 11 through an elongated slit 68 formed in one of the upstanding side plates 11. The two ends of the wire rope 46 (i.e., the free end 48*a* of the section 48*b* and the free end 48*d* of the section 48*c*) are fixed respectively to the ends of the connecting portions 60*a* and 60*b* which are located on opposite sides of the movable pulley 44 as viewed in the reciprocating direction of the first and second reflecting mirror assemblies 3 and 5. The setting member 56 further has suspending portions 62*a* and 62*b* depending from opposite ends of its main portion 58. A tension spring member 64 is stretched between the suspending portion 62*b* and a bracket 66 fixed to the outside surface of one of the upstanding side plates 11. The tension spring member 64 serves to bias the setting member 56 elastically to the right in FIG. 3 and thus to cause the suspending portion 62*a* of the setting member 56 to make elastic contact with any one of the plurality of acting portions 54*a*, 54*b*, 54*c* and 54*d* formed on the peripheral surface of the cam plate 54 (the acting portion 54*a* in FIG. 2**).

When a copy is to be obtained at a magnification of 1:1 with the optical device described hereinabove, the setting cam 53 of the magnification setting mechanism 52 is at the angular position shown by solid lines in FIGS. 2 and 3, the suspending portion **62*a* of the setting member 56 makes elastic contact with the acting portion 54*a* of the cam plate 54, and thus, the setting member 56 is held at a predetermined 1:1 magnification setting position. At this time, the second reflecting mirror assembly 5 is located at the position shown by the solid lines in FIG. 3. When a copying process is started in this state by, for example, depressing a copy start button (not shown), the first reflecting mirror assembly 3 is moved by the driving power source (not shown) from the position shown by the solid lines in FIG. 3 to the right in FIG. 3 at substantially the same speed as the peripheral speed of the rotating drum 14. Simultaneously, the second reflecting mirror assembly 5 is moved by the action of the speed-reduction interlocking mechanism 36 from the position shown by the solid lines in FIG. 3 to the right in FIG. 3 at a speed equal to one-half of the moving speed of the first reflecting mirror assembly 3. As a result, the image of the document A placed on the stationary transparent plate 2 is projected onto the photosensitive material on the rotating drum 14 at a magnification of substantially 1:1 through the first movable reflecting mirror 4, the second movable reflecting mirror 6, the third movable reflecting mirror 8, the stationary lens 10 and the stationary reflecting mirror 12 (see FIG. 1**).

On the other hand, when a copy is to be obtained at a desired magnification ratio m1(m2, m3), a magnification {m1(m2, m3)} selecting button (not shown) is depressed prior to starting of the copying process. As a result, the stationary lens 10 (FIG. 1) is moved by the driving power source (not shown) such as an electric motor over a predetermined distance x, $x=f(1-m1)\{x=f(1-m2), x=f(1-m3)\}$ to the right in FIG. 1 or to the left {when m1(m2, m3)>1}, and simultaneously the setting cam 53 is rotated to an angular position at which the acting portion 54*b* (54*c*, 54*d*) of the cam plate 54 faces the suspending portion 62*a* of the setting member 56. Consequently, the setting member 56 is moved to the left in FIG. 3 against the elastic biasing action of the spring member 64 by a difference between the distance from the rotating center of the cam plate 54 to the acting portion 54*a* and the distance from the rotating center of the cam plate 54 to the acting portion 54*b* (54*c*, 54*d*), and held at the position 56B shown by two-dot chain lines in FIG. 3, i.e. a predetermined m1(m2, m3) setting position. Following the movement of the setting member 56 as above, the wire rope 46 is also moved. Since at this time the first reflecting mirror assembly 3 is drivingly connected to the driving power source in the de-energized state, it remains held at the position shown in FIGS. 2 and 3 without being moved. Hence, by the aforesaid movement of the wire rope 46, the movable pulley 44 mounted rotatably on the second reflecting mirror assembly 5 moves a predetermined distance y, $$y=\frac{f(1-m1)^2}{2m1}\left[y=\frac{f(1-m2)^2}{2m2}, y=\frac{f(1-m3)^2}{2m3}\right],$$

to the right in FIG. 3 while rotating in the direction of the arrow. As a result, the second reflecting mirror assembly 5 moves a predetermined distance y to the left in FIG. 3 and is held at the position 5B shown by two-dot chain lines in FIG. 3. Thereafter, the copying process is started by, for example, depressing the copy starting button (not shown), and the first reflecting mirror assembly 3 is moved from the position shown in FIG. 3 to the right in FIG. 3 at a speed one-mth of the peripheral speed of the rotating drum 14 by a driving power source (not shown) acting through an accelerating mechanism (or decelerating mechanism) not shown. Simultaneously, by the action of the speed-reduction interlocking mechanism 36, the second reflecting mirror assembly 5 is moved from the position 5B shown by two-dot chain lines in FIG. 3 to the right in FIG. 3 at a speed equal to one-half of the moving speed of the first reflecting mirror assembly 3. As a result, the image of the document A placed on the stationary transparent plate 2 is projected onto the photosensitive member on the rotating drum 14 at a magnification ratio of m1 (m2, m3) through the first movable reflecting mirror 4, the second movable reflecting mirror 6, the third movable reflecting mirror 8, the stationary lens 10 and the stationary reflecting mirror 12 (see FIG. 1).

If desired, the setting cam 53 may be rotated manually independently from the movement of the stationary lens 10 for positional change instead of rotating the setting cam 53 in interlocking relation with the movement of the stationary lens 10 for positional change.

The optical device constructed in accordance with this invention described in detail hereinabove can be obtained by attaching the simple and inexpensive magnification setting mechanism 52 including the setting cam 53 and the setting member 56 to an existing conventional optical device used only for obtaining copies at a magnification of 1:1. In the aforesaid optical device of this invention, the spring member 64 acts on the setting member 56 but does not act directly on the first and second reflecting mirror assemblies 3 and 5. Furthermore, the length and tension of the wire rope 46 of the speed-reduction interlocking mechanism 36 do not vary and are always maintained substantially constant. Accordingly, the reciprocating movements of the first and second reflecting mirror assemblies 3 and 5 always are carried out stably.

What is claimed is:

1. For use in a variable magnification electrostatic copying apparatus, an optical device comprising:

a first reflecting mirror assembly mounted for reciprocal movement along a stationary transparent plate on which is to be placed a document to be copied, said first reflecting mirror assembly adapted to be moved at a predetermined speed selected according to a selected copying magnification;

a second reflecting mirror assembly mounted for reciprocal movement substantially parallel to the reciprocating direction of said first reflecting mirror assembly;

a speed-reduction interlocking mechanism means for moving said second reflecting mirror assembly at a speed equal to one-half of the moving speed of said first reflecting mirror assembly according to the movement of said first reflecting mirror assembly, said mechanism means including a pair of stationary pulleys mounted rotatably in spaced-apart relationship in the reciprocating direction of said first and second reflecting mirror assemblies, a movable pulley mounted rotatably on said second reflecting mirror assembly, and a cable wrapped about said pair of stationary pulleys and said movable pulley and fixed to said first reflecting mirror assembly; and a magnification setting mechanism means for changing the relative position of said second reflecting mirror assembly with respect to said first reflecting mirror assembly according to the magnification value, said magnification setting mechanism means including a setting cam having a plurality of acting portions corresponding to a plurality of magnification values, and a setting member mounted for movement substantially parallel to the reciprocating direction of said first and second reflecting mirror assemblies and adapted to be held by said setting cam at any one of a plurality of setting positions corresponding to said plurality of magnification values, opposite free end portions of said cable of said reduction interlocking mechanism means being wrapped over said movable pulley in mutually opposite directions and then fixed to said setting member, such that when said setting member is moved said movable pulley is correspondingly moved to move said second reflecting mirror assembly.

2. An optical device as claimed in claim 1, wherein said setting member has a pair of connecting portions located on opposite sides of said movable pulley as viewed in the reciprocating direction of said first and second reflecting mirror assemblies, and the two ends of said cable are respectively fixed to said pair of connecting portions.

3. An optical device as claimed in claim 2, wherein said setting cam is composed of a rotatably mounted cam plate having said plurality of acting portions formed on its peripheral surface, and said magnification setting mechanism means further includes a spring member for elastically contacting said setting member with said peripheral surface of said cam plate.

4. An optical device as claimed in claim 1, wherein said setting cam is composed of a rotatably mounted cam plate having said plurality of acting portions formed on its peripheral surface, and said magnification setting mechanism means further includes a spring member for elastically contacting said setting member with said peripheral surface of said cam plate.

* * * * *